United States Patent [19]

Fehlner et al.

[11] 4,432,852

[45] Feb. 21, 1984

[54] METHOD AND APPARATUS FOR PRODUCING MICA FILM

[75] Inventors: Francis P. Fehlner; William J. Wein, both of Corning, N.Y.

[73] Assignee: Corning Glass Works, Corning, N.Y.

[21] Appl. No.: 350,289

[22] Filed: Feb. 18, 1982

[51] Int. Cl.[3] ..... C25D 13/02; C25D 13/14

[52] U.S. Cl. ..... 204/181 F; 204/300 EC; 204/291

[58] Field of Search ..... 204/181 F, 300 R, 300 EC, 204/290 R, 291

[56] References Cited

U.S. PATENT DOCUMENTS

| | | | |
|---|---|---|---|
| 2,936,218 | 5/1960 | McNeill et al. | 204/181 F |
| 3,449,227 | 6/1969 | Heron et al. | 204/181 F |
| 3,642,605 | 2/1972 | Chenel et al. | 204/181 F |
| 3,980,547 | 9/1976 | Kunkle | 204/181 F |
| 4,170,542 | 10/1979 | Chronberg | 204/181 F |
| 4,331,525 | 5/1982 | Hubz et al. | 204/181 F |

FOREIGN PATENT DOCUMENTS

| | | | |
|---|---|---|---|
| 55-2047 | 1/1980 | Japan | 204/181 F |

*Primary Examiner*—Richard L. Andrews
*Assistant Examiner*—Terryence Chapman
*Attorney, Agent, or Firm*—K. van der Sterre

[57] ABSTRACT

A continuous method for making mica film by electrophoresis wherein mica is deposited on an endless moving electrode surface from a mica sol, removed from the sol, dried, and finally stripped from the electrode, and apparatus for use in practicing the method, are described.

4 Claims, 2 Drawing Figures

METHOD AND APPARATUS FOR PRODUCING MICA FILM

BACKGROUND OF THE INVENTION

The present invention relates to the fabrication of mica sheet and particularly to a method for making thin, flexible mica film by a continuous electrophoresis process. The film is useful for electrical applications or the like, such as for example a solid electrolyte or electronic insulator.

The preparation of mica sheet by electrophoresis is known. For example, H. R. Shell and K. H. Ivey disclose, in *Fluorine Micas,* U.S. Bur. Mines Bull. 647 (1969) page 223, a batch process wherein delaminated mica crystals about 5–25 microns in diameter are electrophoretically deposited from an n-amyl alcohol suspension onto a nickel or molybdenum cathode. The process produces relatively thick, porous mica films which are subsequently stripped from the metal cathode for recrystallization.

In *Ceramic Industry,* (May, 1980) page 30, F. Handle describes a process for forming clay sheet for dinnerware or tile manufacture. This apparatus utilizes electrophoretic deposition onto counter-rotating zinc-coated cylinders to produce thick (0.08–0.79 in.) sheet.

It has also been proposed to prepare nonwoven materials from organic components using electrophoresis. The deposition of nylon fibers in a polyacrylate binder onto a shaped anode to form a nonwoven fabric is described by R. D. Bankert, et al. in *Textile Res. J,* Vol. 43 (1973), page 247. Brass and aluminum anodes were found to be preferred for this deposition process.

It has recently been discovered that polycrystalline mica film or paper can constitute a suitable solid electrolyte for use in electrochromic devices. The copending, commonly assigned application of G. H. Beall et al., Ser. No. 218,937 filed Dec. 22, 1980 discusses the fabrication of electrochromic devices incorporating mica paper or film electrolytes, and suggests that mica layers for this purpose can be directly deposited on a device electrode by electrophoresis. Mica sols containing small, uniformly sized mica crystals produced in accordance with the teachings of U.S. Pat. No. 4,239,519 were used for this process. However, mica deposition in that case was onto a permanent substrate since the device prepared was not self-supporting.

It is therefore a principle object of the present invention to provide an improved method for providing mica sheet in thin film form for applications wherein strong, self-supporting flexible mica film is required.

It is a further object of the invention to provide a technique for fabricating mica film which is particularly suited to the manufacture of a transparent, solid-state mica electrolyte for thin-film electrochromic devices or the like.

Other objects and advantages of the invention will become apparent from the following description thereof.

SUMMARY OF THE INVENTION

The present invention provides a method for making thin, high-quality mica film by a continuous process. The mica film provided in accordance with the invention is typically strong and self-supporting yet flexible, and may be translucent or substantially haze-free and thus essentially transparent.

The method of the invention utilizes a mica supply which typically consists of a fluid mica sol, i.e., a suspension of electrically charged mica crystals in a liquid vehicle. Mica from this sol is continuously deposited by electrophoresis onto a moving surface which constitutes a first or deposition electrode of an electrophoresis cell, this surface being endless so that it continuously engages and is withdrawn from the sol during the deposition process.

At the same time a second electrode is placed in electrical contact with the mica supply to complete the cell, and the electrophoresis deposition process is driven by a current source which applies an electrical potential between the first and second electrode. This potential is applied such that the first or moving electrode has a potential which is opposite in sign to that of the mica particles and the second electrode. Under the influence of this potential difference, mica is attracted to and deposited from the sol onto the section of the first electrode in contact therewith to form a continuous mica film.

As sections of the first electrode surface coated with film are withdrawn from the sol, the film is allowed to dry by contact with the air or, optionally, with a supplemental dryer, so that it becomes cohesive and strong. It is then continuously removed from the anode, for example by peeling, before the anode surface reengages the mica supply.

Apparatus suitable for practicing the above-described method typically comprises a reservoir for containing the mica sol, and a first electrode disposed on or consisting of a wheel or cylinder positioned so that it is partly immersed in a mica sol provided in the reservoir. The first electrode includes at least the outer circumferential surface of this cylinder so that sections of the electrode surface are continuously engaged and withdrawn from the sol during cylinder rotation.

The apparatus further comprises an electrically conductive second electrode positioned to be in electrical contact with a mica sol present in the reservoir. This second electrode may be a separately immersible plate, or a conductive wall in the reservoir itself, or it may be in a separate container electrically connected to the supply via a salt bridge with an optional ion-permeable membrane. A voltage supply is provided, connected between the two electrodes, which operates to maintain the first electrode at an electrical potential opposite in sign to that of the mica particles and the second electrode, so that mica particles from the sol may be deposited on the first electrode as a continuous film.

Finally, the apparatus comprises means for removing from the surface of the first electrode the mica film deposited thereon. This may comprise a scraper for separating the film from the electrode surface or simply tensioning means such as a weight or take-up reel attached to the end of the film for peeling the film away from the surface.

The apparatus may optionally include supplemental drying means which operate to accelerate the drying of the mica film present on the anode surface as it is withdrawn from the sol. Supplemental drying can improve the cohesiveness of the film so that it may more readily be removed from the anode surface without damage.

The above-described apparatus has been found particularly effective for the fabrication of very thin yet strong and flexible mica film for electrical or other applications wherein thin mica layers are required. Film with these characteristics cannot be readily provided by casting or other continuous processes known in the prior art.

BRIEF DESCRIPTION OF THE DRAWINGS

The invention may be further understood by reference to the drawing wherein.

DETAILED DESCRIPTION

Figure 1:
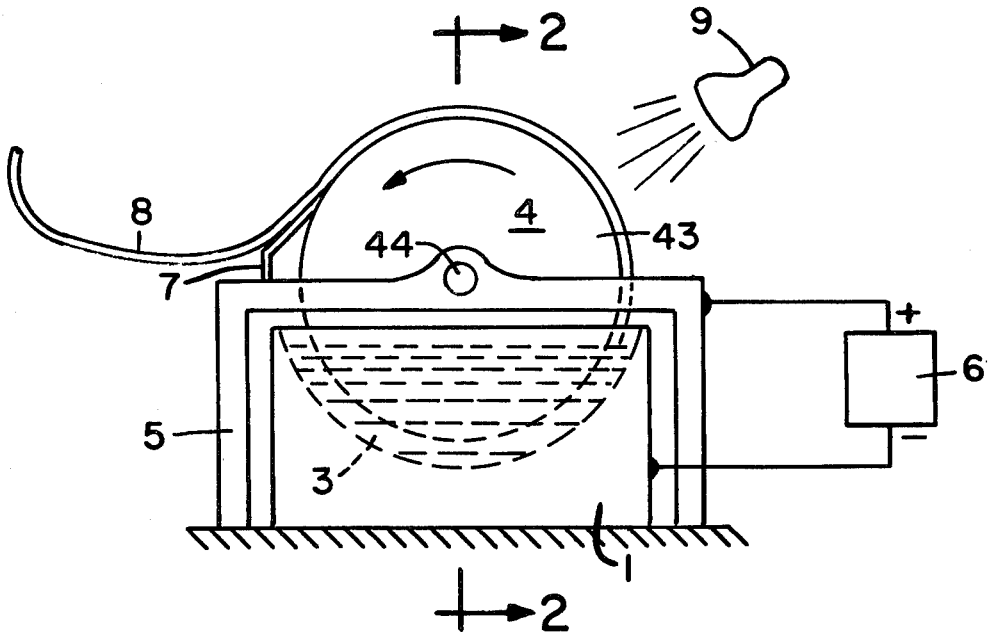
FIG. 1 is a schematic side view in partial cross section of apparatus suitable for continuously producing mica film in accordance with the invention.

The composition of the mica sol used for film deposition in accordance with the invention may of course vary within wide limits depending upon the properties of the film required for the intended application. Both naturally occurring micas and synthetic micas may be employed, but the preferred sols are made using synthetic micas of the type described in U.S. Pat. No. 4,239,519 to G. H. Beall et al. These micas are preferred because they exhibit uniform particle size, typically not exceeding about 20 microns in their largest dimension, and also controlled crystal composition. Such factors are particularly important where strong transparent mica films are desired.

Examples of synthetic micas disclosed in the aforementioned Beall et al patent are lithium and/or sodium water-swelling micas selected from the group comprising fluorhectorite, hydroxyl hectorite, boron fluorphlogopite, hydroxyl boron phlogopite and solid solutions among these and between these and other structurally compatible species selected from the group consisting of talc, fluortalc, polylithionite, fluorpolylithionite, phlogopite and fluorphlogopite. For a further description of these mica materials and methods for preparing gels and sols therefrom, reference may be made to the aforementioned U.S. Pat. No. 4,239,519, and the disclosure of that patent is expressly incorporated herein for a more detailed description of the preparation of suitable mica materials for use in the present invention.

Mica sols useful in accordance with the invention will typically be rather dilute suspensions, preferably comprising 1–5% of suspended mica crystals by weight. More dilute sols might be used to provide very thin film, whereas more concentrated sols increase the incidence of randomly oriented mica crystals on the emerging mica film. Good transparency in the deposited film appears to require that the crystals be largely aligned in planes parallel to the plane of deposition.

The preferred vehicle for use in formulating the sol is water, since water is the polar solvent normally used for breaking down mica precursor bodies and is difficult to completely remove from the mica crystals without a drying treatment. Non-aqueous vehicles such as formamide, alcohols or the like may also be useful, although in some cases surface-active dispersants may have to be added to impart sufficient charge to the mica crystals for sol stabilization and satisfactory electrophoretic deposition.

It is possible to introduce other additives to the sol for the purpose of adjusting the electrical properties of the mica or the vehicle, or for modifying the properties of the mica film. Such may comprise inorganic additives to modify the oxide composition of the film, organic or inorganic additives to act as film binders, and vehicle additions such as the lower aliphatic alcohols which can modify the dielectric constant of the vehicle phase or moderate electrochemical reactions occurring at the cathode or anode.

In the case of the preferred sols, which comprise suspensions of mica crystals in aqueous vehicles such as water or water-alcohol mixtures, the mica crystals are typically negatively charged as dispersed in the vehicle, due to the loss of exchangeable cations such as $Li^+$ to the liquid phase. Thus, electrophoretic mica deposition from such sols will normally occur at the anode of an electrophoresis cell.

In terms of the present process, then, the first or moving electrode, which is the mica film deposition electrode, will normally be established as the anode and the second electrode will be established as the cathode. The following description of the preferred embodiments is therefore set forth in terms of a moving anode for film deposition, although it will be appreciated that the invention encompasses deposition on a moving cathode as well.

Referring to FIG. 1 of the drawing, apparatus provided in accordance with the invention first includes reservoir 1 which contains a supply of mica for deposition such as a fluid mica sol 3. Partially immersed in this sol is anode wheel 4 supported in reservoir 1 by frame 5 and being rotatable in the direction shown.

A voltage source 6 is attached between anode wheel 4 and reservoir 1, connection to wheel 4 suitably being made via frame 5 as hereinafter more fully described. Wheel 4 incorporates an electrically conductive circumferential outer surface and reservoir 1 is suitably formed of an electrically conductive material such as stainless steel. The voltage source is attached so that the anode wheel is positively charged with respect to the reservoir, the latter serving as the cathode for the apparatus in preference to a separate cathode plate.

Optional scraper 7, which may for example be attached to frame 5 as shown, is in contact with the circumferential surface of anode wheel 4 so that it initiates the separation of any mica film adhering thereto, such as film 8 which is electrophoretically deposited on the circumferential outer surface of wheel 4 as it rotates through sol 3 in the direction shown. If the rotation of anode wheel 4 is slow, exposure to air dries film 8 sufficiently so that it may be removed from wheel 4 by scraper 7 without damage. Alternatively, the drying of film 8 may be accelerated by an auxiliary heat source 9, which may be an infrared lamp directed at film 8 as it is transported out of sol 3 by the rotation of the anode wheel.

Figure 2:
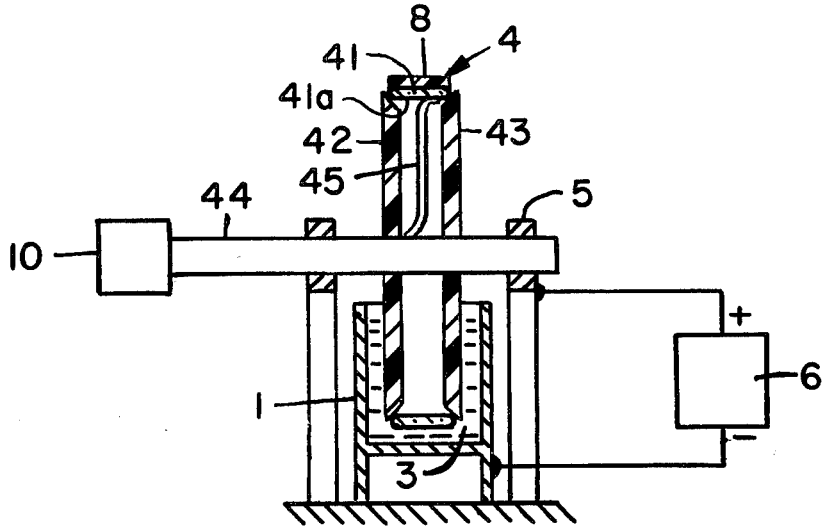
FIG. 2 is a schematic cross-sectional end view of the apparatus as seen along line 2—2 of FIG. 1.

The structure of anode wheel 4 is shown in more detail in FIG. 2 of the drawing. In that construction, the electrically conductive circumferential outer surface of anode wheel 4 is composed of a glass ring 41, all exposed surfaces of which have been covered with a continuous, electrically conductive coating 41 composed of antimony-doped tin oxide. This coating has a composition of about 0.5% $Sb_2O_5$ and the remainder $SnO_2$ by weight, with an electrical resistivity of about 50 ohms/sq.

Plastic hub members 42 and 43 engage ring 41 and support the ring on shaft 44, permitting the anode wheel 4 to rotate through a mica sol 3 provided in reservoir 1 when driven by motor 10. Voltage source 6 applies a positive charge to frame 5, which is connected to shaft 44. Shaft 44 is connected by means of platinum foil connecting strip 45 to the electrically conductive coating on glass ring 41. Voltage source 6 is also connected to reservoir 1 such that the reservoir is maintained at a lower electrical potential than the conductive coating on glass ring 41. The resulting electric field between ring 41 and the bottom of reservoir 1 causes transport of mica crystals from sol 3 onto the surface of anode wheel 4, where it forms a continuous film which is transported out of sol 3 by the rotation of the anode wheel.

A suitable procedure for operating apparatus such as shown in FIGS. 1 and 2 is described in the following illustrative example.

EXAMPLE

A mica sol suitable for use as a mica source in the preparation of a mica film is prepared as follows. A quantity of glass ceramic ribbon comprising a mica crystal phase and having a composition, as calculated from the batch, of about 64.4% $SiO_2$, 10.8% MgO, 16.7% $MgF_2$ and 8.0% $Li_2O$ by weight is prepared substantially as described in U.S. Pat. No. 4,239,519. To enhance purity and transparency in the film product, low-iron MgO, LiF, and $SiO_2$ are used as batch materials. The principal crystal phase present in the ribbon is identified by X-ray diffraction as lithium fluorhectorite, this phase being made up predominately of mica crystals not exceeding about 20 microns in their largest dimension.

The ribbon thus provided is immersed in distilled water for about 24 hours, an exposure interval sufficient to cause essentially complete breakdown of the ribbon to provide a mica suspension. The suspension comprises an aqueous phase containing suspended mica crystals and a sediment phase comprising residual glass and other crystal phases. The suspended mica may be separated from the residue by centrifuging and decantation.

To prepare a sol for electrophoretic deposition, the decanted mica suspension is diluted, first with water and then with methanol, to provide a mica sol containing 1 weight percent of suspended mica crystals, the liquid phase consisting of about 50% $H_2O$ and 50% $CH_3OH$ by volume.

A quantity of the sol thus provided is transferred to a stainless steel reservoir which is connected to the negative terminal of a constant current DC power supply. Plastic side panels are inserted into the reservoir to cover the side surfaces in order to limit the active cathode area of the electrophoresis circuit to the bottom of the reservoir.

The reservoir is then placed under an anode wheel about 1" in width and about 6" in diameter, being positioned so that about 14 centimeters of the peripheral wheel circumference is immersed in the sol. The wheel has substantially the construction shown in FIG. 2 of the drawing, the periphery being constructed of a 1-inch wide section of a 6-inch diameter glass cylinder which has been completely coated with antimony-doped tin oxide to provide an electrical resistivity of about 50 ohms/sq. on the glass surface.

The glass cylinder is supported by opposing TEFLON® plastic hubs on a stainless steel axle, the latter being electrically connected to the cylinder by a strip of platinum foil running from the axle to the inner surface of the glass cylinder between the plastic hubs. This anode wheel is supported on an aluminum frame which is electrically connected to the positive terminal of the DC power supply. Plastic sheeting is placed over the reservoir around the exposed portion of the anode wheel to minimize vehicle evaporation from the mica sol therein.

The power supply is activated and set to provide a constant current of about 15 ma through the mica sol, this current being obtained at a voltage level of about 5–8 volts. Deposition of mica onto the anode commences immediately upon activation of the power supply. Rotation of the anode wheel is then commenced at a rate of about one rotation per hour.

After 20 minutes, the first sections of the anode wheel which have been fully coated with a continuous mica film begin to emerge from the sol. At this time a 100 W infrared heat lamp is directed at the emerging film to accelerate the film drying process. A few minutes later a scraper consisting of a stainless steel razor blade is placed against the surface of the anode wheel about 10 centimeters above the point where the surface would reenter the sol, and removal of the dried mica film from the anode wheel surface commences shortly thereafter. Removal of the film is easy and can be accomplished without the scraper by simply peeling after film separation from the wheel has been initiated.

Mica film which is continuously produced under the deposition conditions described reaches a thickness of about 3 microns, has a width of about 2.5 cm and is essentially completely transparent. It is flexible but sufficiently strong to be handled.

The thickness of film provided in accordance with the above-described illustrative example can readily be controlled by controlling the deposition conditions used. Films ranging in thickness from one micron to several mils can readily be made, and thicker or thinner films are also possible. For best transparency, however, film thicknesses of 1–10 microns are preferred. The known variables for electrophoretic deposition which affect particle migration rate are operative to control film growth rate.

Of course the mica film may include additives to modify the physical and/or electrical properties of the product if desired. Most easily incorporated are materials which can be deposited with the mica by electrophoretic deposition onto the deposition electrode. Phosphates and borates are examples of inorganic additives which can be added to the sol for incorporation into the film, while methyl cellulose is an example of an organic additive. One organic additive, the lithium salt of polystyrene sulfonic acid, has been found effective to enhance both the strength and the clarity of the mica film when added to the sol in concentrations of about $10^{-5}$ to $10^{-4}$ weight percent in a sol containing about 1% mica by weight.

The selection of an electrically conductive anode material is an important variable affecting the success of the method of the present invention. Best results have been obtained with glass supports provided with electrically conductive antimony-doped tin oxide coatings. However, conductive materials such as vitrous carbon, or inert metals such as gold or platinum, would also constitute suitable materials. Most other metals will ordinarily not be selected for the production of the preferred transparent films because they either react chemically with the deposited mica film or present substantial problems in the area of film release. In some cases, the film cannot be easily removed from the anode without damage, and exhibits obvious defects and discoloration attributed to metal contamination. The presently preferred antimony-doped tin oxide anode material exhibits the best combination of chemical inertness and excellent mica film releasability.

Of course the foregoing description and example are merely illustrative of procedures and apparatus which may be employed in carrying out mica film production in accordance with the invention. Numerous variations upon the abovedescribed procedures may be carried out within the scope of the appended claims.

We claim:

1. In the method of producing mica film by the electrophoretic deposition of mica particles from a fluid mica sol onto an electrode surface to form a mica film and the subsequent removal of the film from the surface as cohesive mica film, the improvement wherein the electrode surface consists of a glass which is covered with an electrically conductive antimony-doped tin oxide coating.

2. A method in accordance with claim 1 wherein the electrode surface is endless and is continuously brought into contact with and removed from the mica sol, such that the mica film is continuously formed on and subsequently removed from the electrode surface.

3. A method in accordance with claim 2 wherein the mica film has a thickness in the range of about 1–10 microns.

4. An apparatus for the continuous production of sheet material by the electrophoretic deposition of particulate material from a particulate suspension onto an endless electrode as a continuous layer which is subsequently removed in continuous fashion, said apparatus including a cylindrical rotating electrode for continuous engagement with and withdrawal from the suspension, counter-electrode means in contact with the suspension for maintaining an electric potential between the rotating electrode and counter-electrode within the suspension, voltage supply means for maintaining the electric potential between the electrodes, and layer removal means for removing the layer from the surface of the rotating electrode as it is withdrawn from the suspension, the improvement wherein the surface of the rotating electrode consists of a glass covered with an electrically conductive, antimony-doped tin oxide coating.

* * * * *